US006953086B2

(12) United States Patent
Simpson

(10) Patent No.: US 6,953,086 B2
(45) Date of Patent: Oct. 11, 2005

(54) BI-DIRECTIONAL TRACTION APPARATUS

(75) Inventor: Neil Andrew Abercrombie Simpson, Grampian (GB)

(73) Assignee: Weatherford/Lamb, Inc., Houston, TX (US)

( * ) Notice: Subject to any disclaimer, the term of this patent is extended or adjusted under 35 U.S.C. 154(b) by 85 days.

(21) Appl. No.: 10/432,825

(22) PCT Filed: Nov. 21, 2001

(86) PCT No.: PCT/GB01/05150

§ 371 (c)(1),
(2), (4) Date: May 23, 2003

(87) PCT Pub. No.: WO02/42601

PCT Pub. Date: May 30, 2002

(65) Prior Publication Data

US 2004/0045474 A1 Mar. 11, 2004

(30) Foreign Application Priority Data

Nov. 24, 2000 (GB) ..... 0028619

(51) Int. Cl.[7] ..... E21B 23/14

(52) U.S. Cl. ..... 166/104; 166/173; 166/177.3; 175/99; 104/138.2

(58) Field of Search ..... 166/104, 173, 166/177.3; 175/99; 104/138.2

(56) References Cited

U.S. PATENT DOCUMENTS

| | | | |
|---|---|---|---|
| 866,544 | A | 9/1907 | Walters |
| 1,758,995 | A | 5/1930 | Armstrong et al. |
| 2,214,982 | A | 9/1940 | Wylie |
| 2,518,330 | A | 8/1950 | Jasper et al. |
| 2,539,353 | A | 1/1951 | Minyard |
| 2,668,593 | A | 2/1954 | Hay |
| 3,047,270 | A | 7/1962 | Moore, Jr. |
| 3,056,155 | A | 10/1962 | Hames |
| 3,144,240 | A | 8/1964 | Connell |
| 3,395,759 | A | 8/1968 | Talley, Jr. |

(Continued)

FOREIGN PATENT DOCUMENTS

| | | |
|---|---|---|
| DE | 24 05 343 A1 | 8/1975 |
| DE | 33 11 094 A1 | 9/1984 |
| EP | 0 390 352 A2 | 10/1990 |
| EP | 0 514 039 A1 | 11/1992 |
| EP | 0 523 880 A1 | 1/1993 |

(Continued)

OTHER PUBLICATIONS

PCT International Search Report dated Jul. 31, 2003 based on PCT/EP03/50065.

(Continued)

*Primary Examiner*—David Bagnell
*Assistant Examiner*—G M Collins
(74) *Attorney, Agent, or Firm*—Moser, Patterson & Sheridan, LLP

(57) ABSTRACT

A traction apparatus (1) for propulsion along a bore comprises first and second traction members (6) having outwardly extending legs (14). A propulsion system for operating the traction members (6) comprises a turbine-driven shaft (7) which drives the traction members (6) by way of bearing members (15). In a first phase, one of the legs of the first traction member is moved in one direction whilst in contact with the traction surface to impart the propulsion force at the same time as one of the legs of the second traction member is moved in opposite direction whilst out of contact. In a second phase one of the legs of the second traction member is moved in said one direction whilst in contact with the traction surface to impart the propulsion force at the same time as one of the legs of the first traction member is moved in opposite direction whilst out of contact.

23 Claims, 5 Drawing Sheets

U.S. PATENT DOCUMENTS

| | | | | |
|---|---|---|---|---|
| 3,888,319 | A | 6/1975 | Boume, Jr. et al. | |
| 3,890,905 | A | 6/1975 | Clavin | |
| 3,983,938 | A | 10/1976 | Hellums et al. | |
| 4,007,784 | A | 2/1977 | Watson et al. | |
| 4,031,750 | A | 6/1977 | Youmans et al. | |
| 4,055,315 | A | * 10/1977 | Gvelesiani et al. | 406/185 |
| 4,071,086 | A | 1/1978 | Bennett | |
| 4,192,380 | A | 3/1980 | Smith | |
| 4,243,099 | A | 1/1981 | Rodgers, Jr. | |
| 4,389,208 | A | 6/1983 | LeVeen et al. | |
| 4,457,236 | A | 7/1984 | Akhmadiev et al. | |
| 4,460,920 | A | 7/1984 | Weber et al. | |
| 4,537,136 | A | 8/1985 | Douglas | |
| 4,581,938 | A | 4/1986 | Wentzell | |
| 4,612,986 | A | 9/1986 | Fosdick, Jr. et al. | |
| 4,624,306 | A | 11/1986 | Traver et al. | |
| 4,643,377 | A | 2/1987 | Christianson | |
| 4,648,454 | A | 3/1987 | Yarnell | |
| 4,676,310 | A | 6/1987 | Scherbatskoy et al. | |
| 4,705,107 | A | 11/1987 | Council et al. | |
| 4,747,452 | A | 5/1988 | Clark | |
| 4,854,384 | A | 8/1989 | Campbell | |
| 4,919,223 | A | 4/1990 | Egger et al. | |
| 5,018,451 | A | 5/1991 | Hapstack | |
| 5,121,694 | A | 6/1992 | Zollinger | |
| 5,184,676 | A | 2/1993 | Graham et al. | |
| 5,209,304 | A | 5/1993 | Nice | |
| 5,309,844 | A | 5/1994 | Zollinger | |
| 5,375,668 | A | 12/1994 | Hullundbaek | |
| 5,392,715 | A | 2/1995 | Pelrine | |
| 5,419,397 | A | 5/1995 | Reynolds et al. | |
| 5,625,917 | A | 5/1997 | Hawkins | |
| 5,794,703 | A | 8/1998 | Newman et al. | |
| 5,954,131 | A | 9/1999 | Sallwasser | |
| 6,082,461 | A | 7/2000 | Newman et al. | |
| 6,089,323 | A | 7/2000 | Newman et al. | |
| 6,173,787 | B1 | 1/2001 | Wittrisch | |
| 6,179,055 | B1 | 1/2001 | Sallwasser et al. | |
| 6,179,058 | B1 | 1/2001 | Wittrisch | |
| 6,273,189 | B1 | 8/2001 | Gissler et al. | |
| 6,345,669 | B1 | 2/2002 | Buyers et al. | |
| 6,347,674 | B1 | 2/2002 | Bloom et al. | |
| 6,431,270 | B1 | 8/2002 | Angle | |
| 6,454,011 | B1 | 9/2002 | Schempf et al. | |
| 6,460,616 | B1 | 10/2002 | Simpson | |
| 6,679,341 | B2 | 1/2004 | Bloom | |
| 6,745,839 | B1 | 6/2004 | Simpson | |
| 2002/0104686 | A1 | 8/2002 | Bloom et al. | |
| 2005/0016302 | A1 | 1/2005 | Simpson et al. | |

FOREIGN PATENT DOCUMENTS

| | | | |
|---|---|---|---|
| EP | 0 526 900 | A1 | 2/1993 |
| EP | 1442278 | | 4/2003 |
| FR | 2 355 236 | | 1/1978 |
| FR | 2 495 191 | | 6/1982 |
| FR | 2 667519 | A1 | 10/1993 |
| GB | 614 592 | | 12/1948 |
| GB | 1 124 732 | | 8/1968 |
| GB | 1 418 492 | | 12/1975 |
| GB | 2 305 407 | A | 4/1997 |
| GB | 2 331 347 | A | 5/1999 |
| GB | 2334280 | | 8/1999 |
| GB | 2351304 | | 12/2000 |
| GB | 2 356 439 | A | 5/2001 |
| WO | WO 86/01751 | A1 | 3/1986 |
| WO | WO 91/16520 | | 10/1991 |
| WO | WO 93/18277 | | 6/1993 |
| WO | WO 93/24728 | A1 | 12/1993 |
| WO | WO 94/08728 | A1 | 4/1994 |
| WO | WO 95/21987 | | 8/1995 |
| WO | WO 98/01651 | | 1/1998 |
| WO | WO 98/06927 | | 2/1998 |
| WO | WO 99/36724 | A1 | 7/1999 |
| WO | WO 00/57100 | | 9/2000 |
| WO | WO 00/63606 | A1 | 10/2000 |
| WO | WO 00/73619 | | 12/2000 |
| WO | WO 01/18351 | | 3/2001 |
| WO | WO 02/044509 | | 6/2002 |
| WO | WO 03/078887 | | 9/2003 |

OTHER PUBLICATIONS

International Search Report from the European Patent Office for International Appl. No. PCT/GB00/01360, dated Jul. 28, 2000.

PCT International Search Report from PCT/GB 00/02053, Dated Aug. 22, 2000.

International Search Report Dated Nov. 9, 2000, for Application Ser. No. PCT/GB00/03385.

Simpson, et al., U.S. Appl. No. 10/507,970 filed Sep. 15, 2004, Entitled "Tractors For Movement Along A Pipeline Within A Fluid Flow" [MRKS/0140].

British Search Report dated Feb. 26, 2001, for application No. GB0028619.5.

PCT International Search Report dated Feb. 20, 2002, for application No. PCT/GB01/05150.

U.S. Appl. No. 09/990,026, filed Nov. 21, 2001.

* cited by examiner

BI-DIRECTIONAL TRACTION APPARATUS

This invention relates to traction apparatus, and is concerned especially, but not exclusively, with traction apparatus for propulsion along a bore, for example for use in a downhole tool which is adapted for operation in horizontal wells or bores.

Within the oil and petroleum industry there is a requirement to deploy and operate equipment along bores in open formation hole, steel cased hole and through tubular members such as marine risers and sub-sea pipelines. In predominately vertical sections of well bores and risers this is usually achieved by using smaller diameter tubular members such as drill pipe, jointed tubing or coiled tubing as a string on which to hang the equipment. In many cases the use of steel cable (wire line), with or without electric conductors installed within it, is also common. All of these approaches rely on gravity to provide a force which assists in deploying the equipment.

In the case of marine pipe lines which are generally horizontal, "pigs" which are basically pistons sealing against the pipe wall, are used to deploy and operate cleaning and inspection equipment, by hydraulically pumping them along the pipe, normally in one direction.

Within the oil and petroleum industry to date the requirement to deploy equipment has been fulfilled in these ways.

However, as oil and gas reserves become scarcer or depleted, methods for more efficient production are being developed.

In recent years horizontal drilling has proved to enhance greatly the rate of production from wells producing in tight or depleted formation. Tight formations typically are hydrocarbon-bearing formations with poor permeability, such as the Austin Chalk in the United States and the Danian Chalk in the Danish Sector of the North Sea.

In these tight formations oil production rates have dropped rapidly when conventional wells have been drilled. This is due to the small section of producing formation open to the well bore.

However, when the well bore has been drilled horizontally through the oil producing zones, the producing section of the hole is greatly extended resulting in dramatic increases in production. This has also proved to be effective in depleted formations which have been produced for some years and have dropped in production output.

However, horizontal drilling has many inherent difficulties, a major one being that the forces of gravity are no longer working in favour of deploying and operating equipment within these long horizontal bores.

This basic change in well geometry has led to operations which normally could have been carried on wireline in a cost effective way now being carried out by the use of stiff tubulars to deploy equipment, for example drill pipe and tubing conveyed logs which cost significantly more to run than wireline deployed logs.

Sub-sea and surface pipeline are also increasing in length and complexity and pig technology does not fully satisfy current and future needs. There is currently a need for a traction apparatus which can be used effectively in downhole applications including horizontal bores.

Reference is also made to the Applicants' Patent Publication No. WO 98/06927 which discloses a traction apparatus comprising a body incorporating first and second traction members comprising brushes and spaced apart along the body for engaging a traction surface. Each traction member is urged against the traction surface such that the traction member is movable relatively freely in one direction, but substantially less freely in the opposite direction. Furthermore propulsion means, such as a motor and associated rotary bearing members, are provided for operating the traction members to move the body along the traction surface. The propulsion means acts, in a first phase, to urge part of the first traction member outwardly against the traction surface to impart a propulsion force to the body in the one direction, and, in a second phase, which alternates with the first phase, to urge part of the second traction member outwardly against the traction surface to impart a further propulsion force to the body in the one direction.

Reference is also made to the Applicants' Patent Publication No. WO 00/73619 which discloses a traction apparatus adapted for travel through a bore containing a moving fluid stream. The tractor comprises a body, propulsion means in the form of traction members for engagement with a traction surface to propel the body in a desired direction, a turbine member mounted on the body and adapted to be driven by the moving fluid, and a conversion arrangement for converting movement of the turbine member to drive for the traction members. The drive arrangement may include a contactless magnetic coupling and a harmonic drive. However there may be applications in which insufficient power is available from the fluid flow to drive the traction members.

It is an object of the invention to provide more efficient traction apparatus.

According to the present invention there is provided a traction apparatus comprising a body incorporating first and second traction members spaced apart along the body for engaging an inner traction surface at locations spaced apart along the traction surface in the direction in which the apparatus is to be moved, each traction member having a plurality of outwardly extending legs substantially equiangularly distributed about a central axis, and propulsion means for operating the traction members to move the body along the traction surface, the propulsion means acting, in a first phase, to move one of the legs of the first traction member in one direction relative to the body whilst in contact with the traction surface to impart the required propulsion force at the same time as one of the legs of the second traction member is moved in the opposite direction relative to the body whilst out of contact with the traction surface, and the propulsion means acting, in a second phase, which alternates with the first phase, to move one of the legs of the second traction member in said one direction whilst in contact with the traction surface to impart the required propulsion force at the same time as one of the legs of the first traction member is moved in said opposite direction whilst out of contact with the traction surface.

Such an arrangement is particularly advantageous as it enables the propulsion force to be optimised whilst limiting any undesirable frictional effects which would tend to increase the power required to drive the traction members.

In a development of the invention reversing means is provided for reversing the direction in which the propulsion means moves the body along the traction surface. In one embodiment the reversing means comprises a respective hub member carrying each traction member and mounted on the outer surface of a rotary bearing member which is inclined relative to its axis of rotation, the hub member being slidable along the bearing member between a first position on one side of a neutral point in which propulsion is caused to take place in one direction along the traction surface and a second position on the other side of the neutral point in which propulsion is caused to take place in the opposite direction along the traction surface.

In an alternative embodiment the reversing means comprises pivoting means for pivoting the outer ends of the legs of the traction members between a first position on one side of a neutral point in which propulsion is caused to take place in one direction along the traction surface and a second position on the other side of the neutral point in which propulsion is caused to take place in the opposite direction along the traction surface.

In a still further embodiment the reversing means comprises eccentric cam means bearing each traction member and capable of limited rotation relative to the traction member so as to cause the contact points of the legs of the traction member with the traction surface to be moved between a first position on one side of a neutral point in which propulsion is caused to take place in one direction along the traction surface and a second position on the other side of the neutral point in which propulsion is caused to take place in the opposite direction along the traction surface.

The invention will now be described, by way of example, with reference to accompanying drawings, in which.

Figure 7:
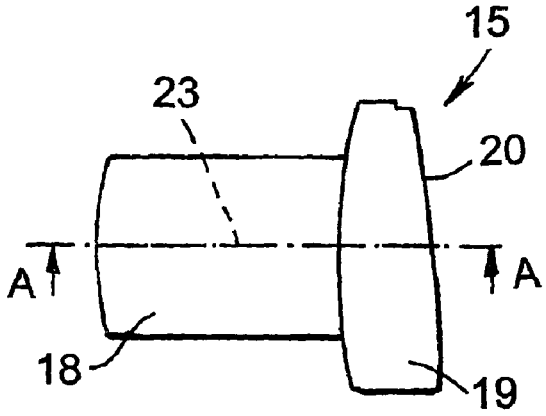

FIG. 7 being a side view and

Figure 8:
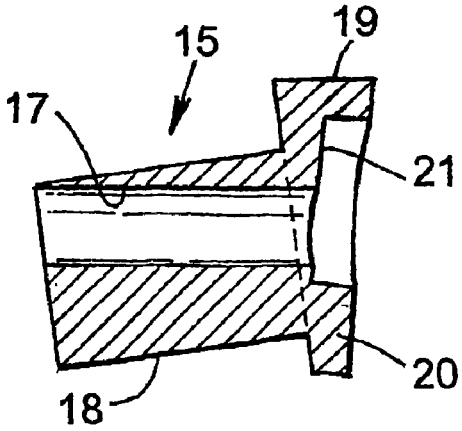
Figure 9:
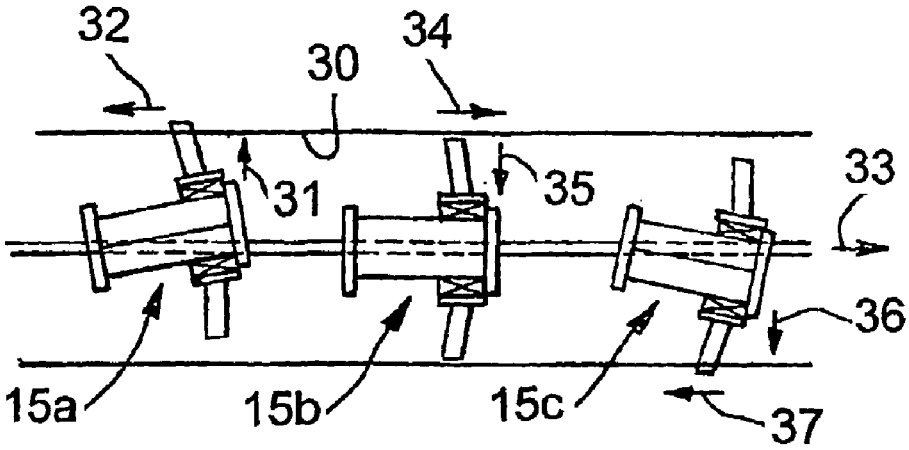
Figure 10:
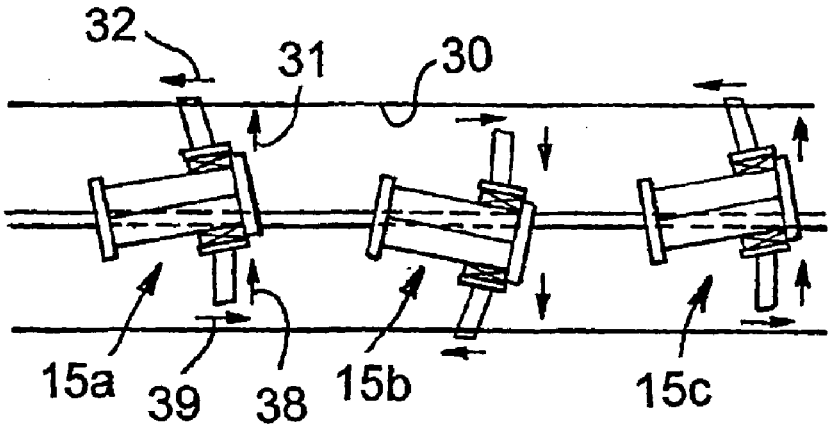
Figure 11:
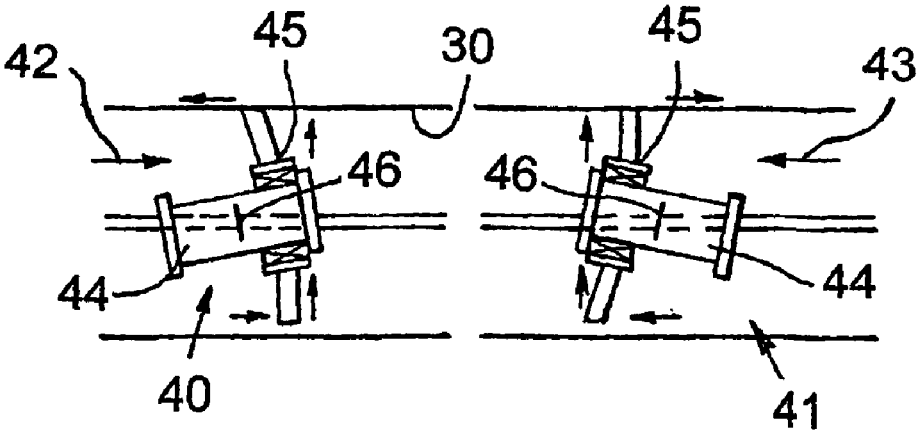

FIG. 8 being a section along the line A—A in FIG. 7;

FIGS. 9 and 10 are explanatory diagrams showing two alternative methods of operation of such a tool;

FIG. 11 is an explanatory diagram showing an arrangement for changing the direction of travel of the tool; and FIGS. 12, 13, 14 and 15 are explanatory diagrams showing four different mechanisms for changing the direction of travel of the tool.

Figure 1:
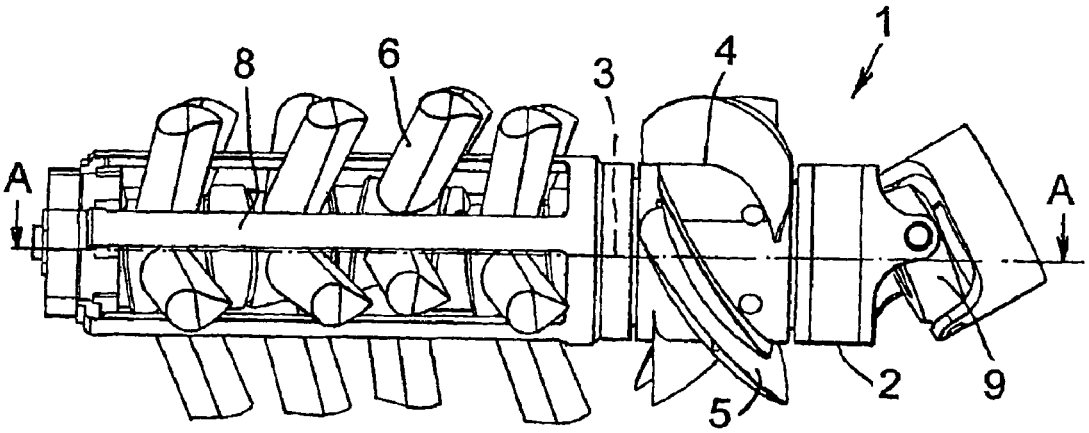
FIG. 1 is a side view of an embodiment of traction apparatus in accordance with the invention incorporated in a downhole tool.

FIG. 1 shows an embodiment of traction apparatus incorporated in a downhole tool 1 which is designed to be introduced as a close fit within the bore of a pipeline and to be driven along the bore to an intended location, for example to remove an obstruction. The downhole tool 1 comprises an elongate body 2 having a longitudinal axis 3, a turbine rotor 4 with generally helical blades 5 being rotationally mounted on the body 2. The turbine rotor 4 is arranged to be driven by the flow of fluid over the body 2 and is linked to a central drive shaft 7 (see FIG. 2) for driving four traction members 6 made of resilient elastomeric material, as will be described in more detail below. The traction members 6 are prevented from rotating with the drive shaft 7 by cage elements 8 extending longitudinally of the body 2. Furthermore a universal joint 9 mounted at one end of the body 2 is provided for coupling to the body of an adjacent unit.

The tool may comprise a number of interlinked traction units coupled together by universal joints such that the complete tool is capable of adapting to the curvature of a bend in the pipeline along which it is to be moved. Where a multi-unit modular construction is used for the downhole tool 1, the leading unit may be coupled to an obstruction sensor unit, whilst the trailing unit may be coupled to a service module, both such couplings also being by way of universal joints.

Figure 2:
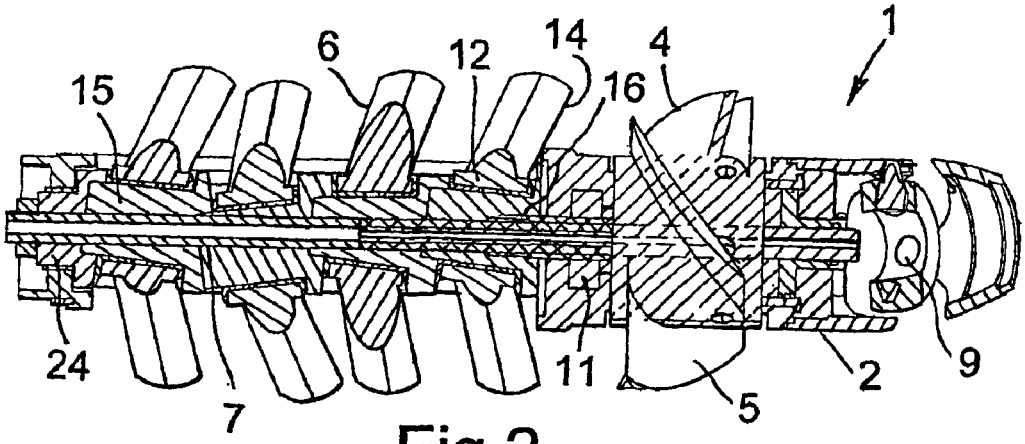
FIG. 2 is a cross-sectional view taken along the line A—A in FIG. 1.
Figure 3:
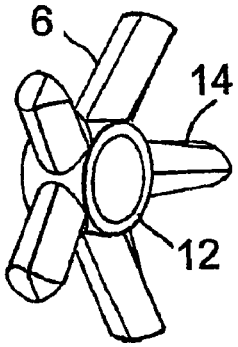
FIG. 3 is a perspective view of a single traction member of the embodiment of FIG. 1.

Referring to FIG. 2, the power from the turbine rotor 4 is supplied to the drive shaft 7 by way of a contactless magnet coupling (not shown) utilising cooperating magnets which act through an intervening non-magnetic body portion. Furthermore the drive to the drive shaft 7 acts through a gear box 11 which is in the form of a harmonic drive. Each of the traction members 6 comprises a cylindrical sleeve 12 having five outwardly extending legs 14 of aerofoil section which are equiangularly distributed about a control axis and are inclined forwardly with respect to the intended direction of movement of the tool, as best seen in FIG. 3.

Each of the traction members 6 is mounted on the drive shaft 7 by means of a respective rotary bearing member 15 which is rotatable by the drive shaft 7 to bias each of the legs 14 of the corresponding traction member 6 in turn against the inner surface of the bore in order to move the tool along the bore. As best seen in FIG. 2 the bearing members 15 are each inclined relative to their common axis of rotation and fit together with one another such that the directions in which they are inclined are offset at different angles about the axis of rotation. This ensures that, as the bearing members 15 are rotated by the drive shaft 7 by the engagement of splines 16 on the drive shaft 7 within internal grooves in a first of the bearing members 15, the legs 14 of adjacent traction members 6 are oscillated or swashed backwards and forwards out of phase with one another, as will be described in more detail below.

Figure 4:
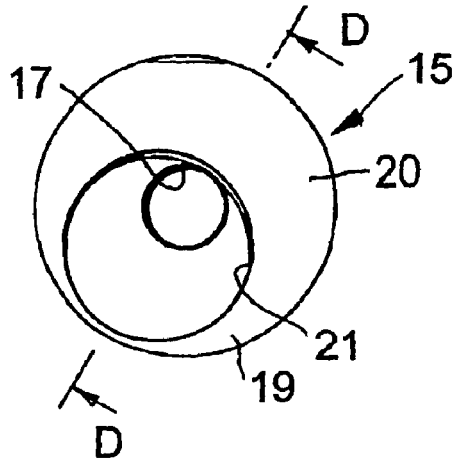
FIG. 4 is an end view of a single bearing member of the embodiment of FIG. 1, FIG. 5 being a section along the line D—D in FIG. 4.
Figure 5:
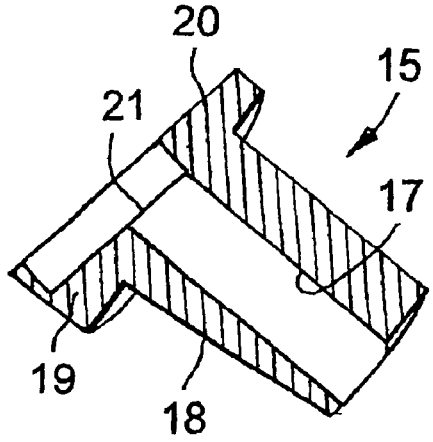
Figure 6:
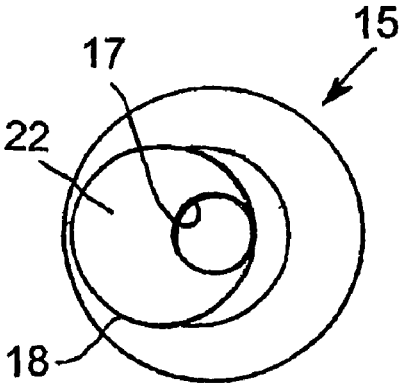
FIG. 6 is an opposite end view of the bearing member of FIG. 1.

FIGS. 4, 5. 6, 7 and 8 illustrate the complex shape of each bearing member 15 having an inner bore 17 which is skewed with respect to the cylinder outer surface 18 of the bearing member 15. The bearing member 15 also has a flange 19 at one end defining an inclined end surface 20 and a circular recess 21 in the end surface for receiving the opposite end of an adjacent bearing member. As best seen in FIG. 4, the bore 17 opens centrally within the end surface 20 within the recess 21, whereas, as best seen in FIG. 6, the bore 17 opens at a point which is offset from the centre of the opposite end surface 22. The skewing of the bore 17 with respect to the axis 23 of rotation of the bearing member 15 can also be seen by comparing the sectional view of FIG. 5 taken along the line D—D in FIG. 4 with the sectional view of FIG. 8 taken along the line A—A in FIG. 7. Each of the bearing members 151 is of the general form described above, except that the first bearing member 15 is provided with inner grooves in place of the recess 21 for engagement by the drive splines. Furthermore an additional bearing member 24 is provided, as shown in FIG. 2, for engagement with the bearing member 15 associated with the final traction member 6, the bearing member 24 being of generally similar form to the other bearing members 15 except that it has a truncated body and a bore which is concentric with its outer cylinder surface.

The form of such bearing members ensures that the traction members 6 are at different positions in their cycles at any particular instant in time, as may readily be seen in FIGS. 1 and 2. Although rotation of the traction members 6 on the drive shaft 7 is prevented by the cage elements 8, the mounting of the cylindrical sleeve 12 of each traction member 6 on the cylindrical outer surface 18 of the associated bearing member 15 (with the provision of an intermediate bearing race where necessary) ensures that the legs 14 of the traction member 6 are caused to oscillate backwards and forwards and inwardly and outwardly by virtue of the rotation of the bearing members 15 with the drive shaft 7. Whilst the relative movements of the legs 14 of adjacent traction members 6 will vary depending on the number of traction members provided and the number of outwardly extending legs on each traction member, as well as the required phase configuration, the relative positions of three of the traction members 6 at a particular instant are shown in FIG. 9 for the case where adjacent traction members have their cycles offset by 90° with respect to one another.

Referring to FIG. 9, and considering the positions of the traction members 15*a*, 15*b* and 15*c* from left to right, one of the legs of the first traction member 15*a* is moved outwardly and rearwardly as indicated by the arrows 31 and 32 in contact with the bore wall 30 so as to provide a reaction force tending to move the tool in the direction of the arrow 33. At the same time the second bearing member 15*b*, which is 90° out of phase with the first bearing member 15*a*, maintains the corresponding leg out of contact with the bore wall 30 whilst the leg is moved forwardly and inwardly as shown by the arrows 34 and 35. Of course other legs of the same traction member are at the same time being moved into contact with the bore wall by the bearing member 15*b*. At the same time the third bearing member 15*c* is positioned so as to cause a leg on the opposite side of the traction member to be moved outwardly and rearwardly as shown by the arrows 36 and 37 in contact with the bore wall 30 so as to again produce a propulsion force in the direction of the arrow 33.

Thus it will be appreciated that the relative phase positions of the four traction members are such as to provide a net propulsion force in the direction 33 of intended movement, with the swashing movement imparted to the traction members moving the legs of each traction member outwardly into contact with the bore wall and rearwardly to apply the propulsion force, and then inwardly out of contact with the bore wall and forwardly to complete the cycle. Since each leg is out of contact with the bore wall as it is moved forwardly, it will be appreciated that no drag on the forward motion of the tool is provided during this part of the cycle.

FIG. 10 is a similar explanatory diagram to that of FIG. 9 except that, in this case, the bearing members 15*a*, 15*b* and 15*c* are out of phase by 180° with respect to one another. In this case the bearing member 15*a* is in the same position as in FIG. 9 with the upper leg of the traction member being moved outwardly and rearwardly in contact with the bore wall 30 (whilst at the same time an opposite leg is being moved inwardly and forwardly as shown by the arrows 38 and 39). However the second bearing member 15*b* is advanced by 180° with respect to the first bearing member 15*a*, and is therefore in the same position as the bearing member 15*c* of FIG. 9. Furthermore the third bearing member 15*c* is in the same position as the first bearing member 15*a* with the upper leg again being moved outwardly and rearwardly in contact with the bore wall 30.

It will be appreciated that the propulsion method described above requires that the legs of each traction member are offset forwardly of the neutral point of the corresponding bearing member, with the legs being inclined by a small angle rearwardly relative to the intended direction of travel. Furthermore, in the absence of any special measures being provided, the tool will only be capable of travelling along the borehole in one direction. In a development of the invention, reversing means are provided to enable the tool to travel in one direction on an outward leg and to then travel in the opposite direction on the return leg.

In a first example of such reversing means, two drive modules, similar to that shown in FIGS. 1 and 2, are coupled together back-to-back such that the legs of the traction members in one of the drive modules are inclined forwardly and the legs of the traction members in the other drive module are inclined rearwardly. When the tool is to be moved in one direction, the drive shaft of the corresponding module is rotated to drive the tool utilising the traction members with forwardly inclined legs, whilst disabling the other drive module during such movement by collectively disengaging all the legs of its traction members away from contact with the inner surface of the bore, for example by pushing the legs out of contact with the surface by means of a sleeve or the bars of a cage element. However such an arrangement is not particularly efficient since only one of the drive modules is utilised at any one time, and this would therefore require a tool of twice the length to obtain the same amount of drive as a corresponding tool designed to travel in only one direction. There is also the issue of deploying the activation sleeves which may not be a straightforward operation.

In an alternative arrangement a reverse hub principle is used based on the following. In the arrangement described with reference to FIGS. 1 to 10 for moving a tool in one direction of travel, the contact point of each leg must lie ahead of the neutral offset point, or centre point of swash, of the skewed bearing member. The distance of the contact point from the neutral offset point defines the height of the step, that is the distance between the innermost and outermost positions of each leg, and thus determines the contact pressure with respect to the bore wall 30. Furthermore the degree of skewing or swash angle of the bearing member determines the length of the step, that is the distance between successive contact points of a leg with the bore wall. If the contact point lies behind the neutral offset point, the tool will generate traction in the opposite direction, and the reverse hub principle relies on being able to move the contact point from one side of the neutral point to the other. There are a number of ways in which this can be achieved.

FIG. 11 shows a preferred arrangement for changing the direction of travel and illustrates an operational mode 40 for propelling the tool in one direction 42 of travel, and an operational mode 41 for propelling the tool in the opposite direction 43 of travel. In this arrangement the bearing member is in the form of a double length hub 44 supporting a standard length bearing/traction member assembly 45. With the assembly 45 positioned at the end of the hub 44 to one side of the neutral offset point 46 as shown in the mode 40, the tool is driven in the direction 42. However, if the assembly 45 is slid to the opposite end of the hub 44 on the other side of the neutral offset point 46, the direction of travel is changed to the direction 43. In order to change from mode 40 to mode 41, it is necessary for the assembly 45 associated with each traction member to be pulled against its own traction force to the opposite end of the hub 44, and various alternative mechanisms for effecting this change of mode will be discussed below with reference to FIGS. 12 to 14.

Figure 12:
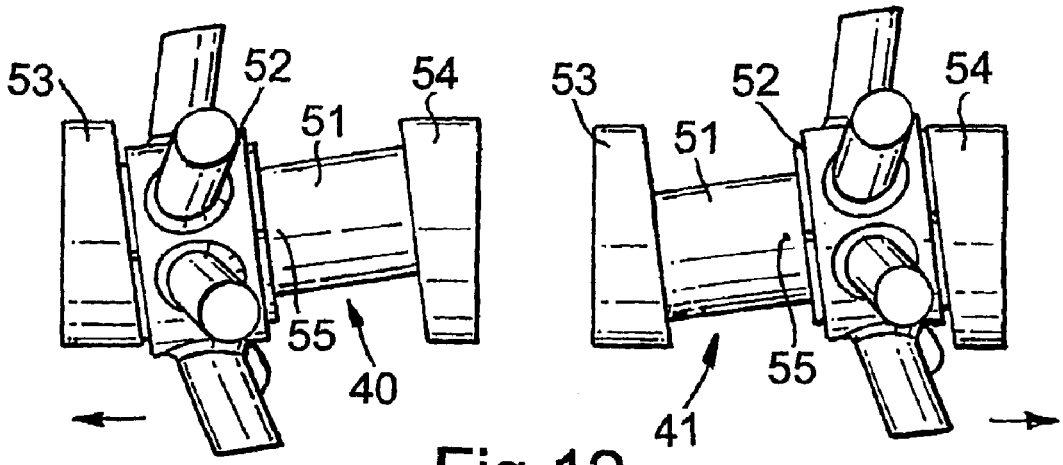

FIG. 12 shows the two modes 40 and 41 of an arrangement having a double length hub 51 supporting a standard length bearing/traction member assembly 52 and having thrust flanges 53 and 54 at its ends. In the mode 40 the assembly 52 is in contact with the lefthand thrust flange 53 and is positioned to the left of the neutral offset point 55 which will cause the assembly 52 to pull to the left thus holding it against the flange 53. If rotation of the drive to the traction apparatus is then stopped and the drive shaft, and all the bearing members mounted on it, are pushed to the left, the assemblies 52 in contact with the bore wall will collectively be pushed to the right of the neutral offset point 55 so as to contact the righthand thrust flange 54, to thereby place the tool in the other mode 41. Restarting of rotation of the drive shaft will then cause traction to be resumed, but in the opposite direction to before.

Figure 13:
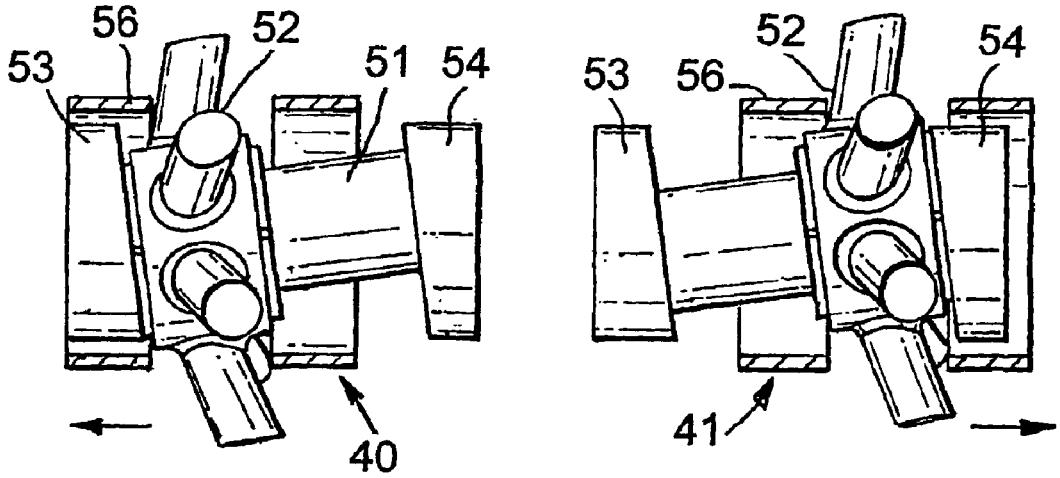

FIG. 13 shows an alternative arrangement in which shifting of the assembly 52 from the lefthand side to the righthand side of the neutral offset point is effected by an common cage element 56 which is slidably mounted over the different assemblies 52 such that, when it is slid from left to right (preferably when the drive has been stopped), it collectively pushes the assemblies to the righthand side of the neutral offset point.

Figure 14:
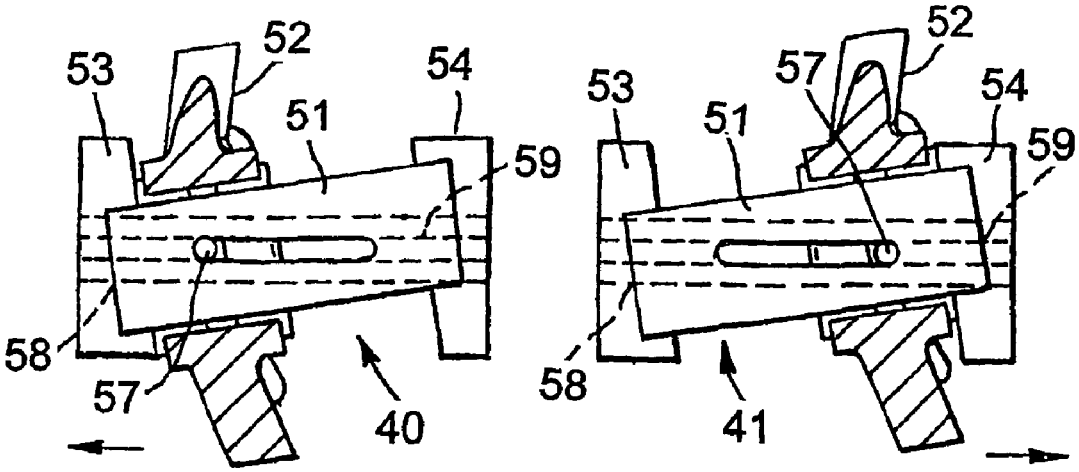

FIG. 14 shows a further alternative arrangement with the assembly 52 partly in section so as to show a toggle pin 57 on an activation shaft 59 extending internally of the drive shaft 58 (shown in broken lines) and passing through slots 60 in the drive shaft 58 and the hub 51 to engage in a circular groove (not shown) in the inner wall of the assembly 52. It will be appreciated that the assemblies 45 can be moved collectively from left to right by axial movement of the activation shaft 59 to reverse the direction of travel. Instead of using pins for coupling of such an activation shaft to the assemblies, it would alternatively be possible to use a magnetic coupling, or to use some other mechanism, for example a hydraulic actuating mechanism, for moving the assemblies from one end to the other of the hub.

Such an arrangement for permitting the direction of travel of the tool to be changed suffers from the disadvantage that it increases the length of the tool. This is less likely to be an issue in larger diameter pipe, or in downhole applications where the bend radius of the bore is very large, although it may require a number of modifications to the layout of the tool for smaller diameter applications. The force for moving the activation shaft in such an arrangement could be generated hydraulically or by a solenoid or magnetic actuator or other electromechanical actuator. Alternatively the force could be triggered by a gauge ring or probe, or the change in mode could be initiated simply by the traction force when an obstacle is encountered by the tool. In some applications it may be convenient for such actuation to be under control of a timer mechanism.

In a variation of the above described method for changing the direction of travel, the bearing hub is fixed, and a control mechanism is provided for moving the outer ends of the legs of the traction members from one side to the other of the neutral point, the legs being pivotal about pivot points and preferably operating on a swash-type gimbal similar to that used in a helicopter rotor control mechanism. In order to change from one direction of travel to the other direction of travel, a control rod is operated to pivot the ends of the legs from one side to the other of the neutral offset point. Although such a mechanism is necessarily quite complex, it has the advantage that it can be adapted also to control the traction, speed and gauge of the tool.

Figure 15:
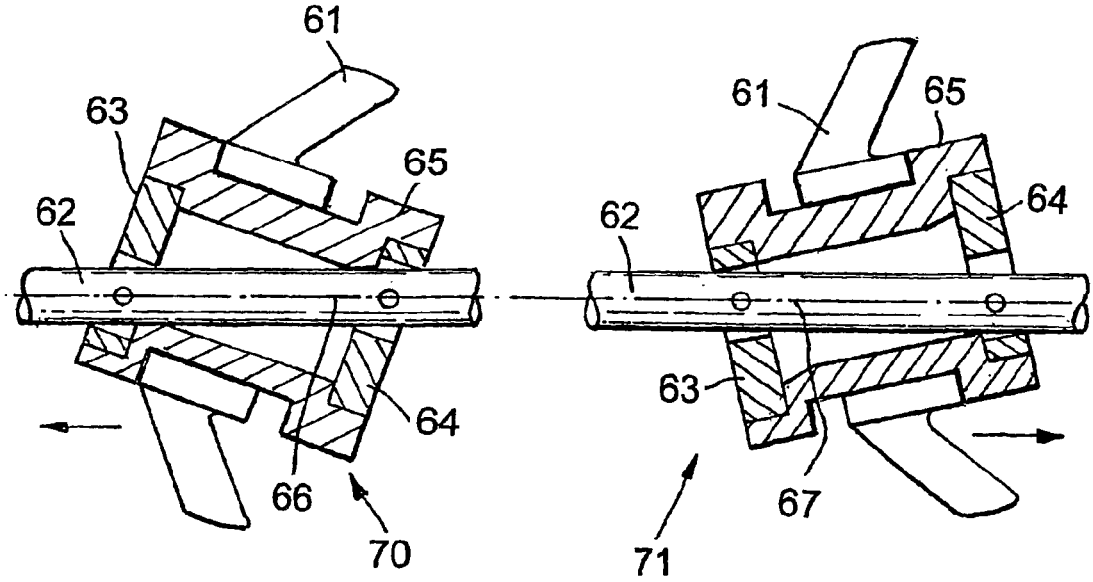

FIG. 15 shows an alternative arrangement in which a bearing/traction member assembly 61 comprises two eccentric cams 63 and 64 fixed to a drive shaft 62 and supporting the bearing member 65 on the drive shaft 62 such that the cams 63 and 64 are capable of rotation through a limited angle of 180° relative to the bearing member 65. Rotation limit stops on the cams 63 and 64 are provided such that, starting from the mode 70 shown in FIG. 15, righthand rotation of the drive shaft 62 will cause rotation of the assemblies 61 to drive the tool along the borehole in one direction, whereas lefthand rotation of the drive shaft 62 will cause both cams 63 and 64 to rotate through 180° within the bearing member 65 with the result that the neutral offset point will move from the position 66 in the mode 70 to the position 67 in the mode 71. Thus reverse rotation of the drive shaft 62 can be used to effect reversal of the direction of travel of the tool. In the mode 70 the cam 64 holds the neutral offset point in the position 66 in line with the drive shaft axis and the cam 63 applies the offset, whereas, in the mode 71, the cam 63 holds the neutral offset point in the position 67 while the cam 64 applies the offset, with the result that the position in which the legs of the traction member contact the bore wall is behind the neutral offset point, thus reversing the direction of travel.

The downhole tool described with reference to the drawings is advantageous in that motive power is provided by a moving fluid stream and there is no need for the tool to carry its own power supply or to be linked to a remote power source. Furthermore the tool may be arranged to be driven either in the same direction as the fluid or in the opposite direction to the fluid, that is against the flow. The tool may carry cutting means, such as a radially or axially extending blade, for removing deposits on the bore wall or for dislodging an obstruction. The cutting means may alternatively be constituted by fluid jets or an ultrasonic emitter.

What is claimed is:

1. A traction apparatus comprising:

a body incorporating at least two traction members spaced apart along the body for engaging an inner traction surface at locations spaced apart along the traction surface in the direction in which the apparatus is to be moved, each traction member having a plurality of outwardly extending legs substantially equiangularly distributed about a central axis, wherein:

each traction member is mounted on an outer surface of a rotary bearing member which is rotatable to bias each of the legs in turn against the traction surface; and each rotary bearing member has a recess in one end for receiving an opposite end of an adjacent rotary bearing member; and propulsion means for operating the traction members to move the body along the traction surface, wherein:

the propulsion means acts in a first phase to move one of the legs of the first traction member in one direction relative to the body whilst in contact with the traction surface to impart the required propulsion force at the same time as one of the legs of the second traction member is moved in the opposite direction relative to the body whilst out of contact with the traction surface, and the propulsion means acts in a second phase, which alternates with the first phase, to move one of the legs of the second traction member in said one direction whilst in contact with the traction surface to impart the required propulsion force at the same time as one of the legs of the first traction member is moved in said opposite direction whilst out of contact with the traction surface.

2. A traction apparatus according to claim 1, wherein each traction member comprises a sleeve from which the legs extend outwardly.

3. A traction apparatus according to claim 1, wherein each traction member comprises resilient material.

4. A traction apparatus according to claim 3, wherein each traction member is made of an elastomeric material.

5. A traction apparatus according to claim 1, wherein each leg has an aerofoil cross-section.

6. A traction apparatus according to claim 1, wherein each traction member has five outwardly extending legs.

7. A traction apparatus according to claim 1, wherein the outer surface of the rotary bearing member is inclined relative to its axis of rotation so that outermost parts of the legs of the traction member are movable outwardly and inwardly relative to a central axis as the rotary bearing member rotates.

8. A traction apparatus according to claim 1, wherein the rotary bearing member is in the form of a sleeve having a bore extending therethrough such that the bore is inclined at an angle relative to the outer surface of the rotary bearing member.

9. A fraction apparatus according to claim 1, wherein the traction member is mounted on the rotary bearing member such that the traction member does not rotate with the rotary bearing member to any substantial extent.

10. A traction apparatus according to claim 1, wherein the outer surfaces of the rotary bearing members are inclined relative to one another and relative to their axis of rotation.

11. A traction apparatus according to claim 1, wherein the legs of the traction members are maintained in defined angular positions by axially extending cage members.

12. A traction apparatus according to claim 1, wherein the traction members are driven by a common drive shaft.

13. A traction apparatus according to claim 1, further comprising reversing means for moving the body along the traction surface in an opposite direction of the direction that the propulsion means moves the body along the traction surface.

14. A traction apparatus according to claim 13, wherein the reversing means comprises a respective hub member carrying each traction member and mounted on the outer surface of a rotary bearing member which is inclined relative to its axis of rotation, the hub member being slidable along the bearing member between a first position on one side of a neutral point in which propulsion is caused to take place in one direction along the traction surface and a second position on the other side of the neutral point in which propulsion is caused to take place in the opposite direction along the traction surface.

15. A traction apparatus according to claim 13, wherein the reversing means comprises pivoting means for pivoting the outer ends of the legs of the traction members between a first position on one side of a neutral point in which propulsion is caused to take place in one direction along the traction surface and a second position on the other side of the neutral point in which propulsion is caused to take place in the opposite direction along the traction surface.

16. A traction apparatus according to claim 13, wherein the reversing means comprises eccentric cam means bearing each traction member and capable of limited rotation relative to the traction member so as to cause the contact points of the legs of the traction member with the traction surface to be moved between a first position on one side of a neutral point in which propulsion is caused to take place in one direction along the traction surface and a second position on the other side of the neutral point in which propulsion is caused to take place in the opposite direction along the traction surface.

17. A traction apparatus according to claim 1, wherein the propulsion means incorporates an electric motor.

18. A traction apparatus according to claim 1, wherein the propulsion means incorporates a turbine rotor to be driven by fluid flow.

19. A traction apparatus, comprising:

a body;

at least two a bearing members for rotation about a longitudinal axis of the body; each bearing member providing an outer surface inclined relative to the axis, wherein each bearing member has a recess in one end for receiving an opposite end of an adjacent bearing member;

means for rotating the bearing member; and a plurality of outwardly extending legs distributed about the outer surface of each bearing member, each leg having at least one end portion thereof for selectively engaging an inner traction surface as the bearing member rotates thereby alternating between an inward and first direction movement of the leg and an outward and second direction movement of the leg to provide a propulsion force.

20. The traction apparatus of claim 19, further comprising a hub member carrying the plurality of outwardly extending legs and mounted on the outer surface of the bearing member.

21. The traction apparatus of claim 19, further comprising reversing means for reversing the propulsion force.

22. The traction apparatus of claim 19, further comprising:

reversing means for reversing the propulsion force; and a hub member carrying the plurality of outwardly extending legs and mounted on the outer surface of the bearing member.

23. A traction apparatus, comprising:

a body having a longitudinal axis;

a bearing member for rotation about the longitudinal axis of the body, the bearing member providing an outer surface inclined relative to the axis;

means for rotating the beating member;

a plurality of outwardly extending legs distributed about the outer surface of the bearing member, each leg having at least one end portion thereof for selectively engaging an inner traction surface as the bearing member rotates thereby alternating between an inward and first direction movement of the leg and an outward and second direction movement of the leg to provide a propulsion force;

reversing means for reversing the propulsion force; and a hub member carrying the plurality of outwardly extending legs and mounted on the outer surface of the bearing member, wherein a portion of the bearing member that the hub member mounts to is at least twice the length of the hub member, the hub member moveable along the portion between a first position on one side of a neutral point in which the propulsion force is directed in the first direction and a second position on the other side of the neutral point in which the propulsion force is directed in the second direction.

* * * * *

UNITED STATES PATENT AND TRADEMARK OFFICE

CERTIFICATE OF CORRECTION

PATENT NO. : 6,953,086 B2
APPLICATION NO. : 10/432825
DATED : May 23, 2003
INVENTOR(S) : Neil Andrew Abercrombie Simpson It is certified that error appears in the above-identified patent and that said Letters Patent is hereby corrected as shown below:

In column 10, Claim 19, line 3, please delete “a” after “two”.

In column 10, Claim 19, line 4, please delete “;” after “body” and insert --,--.

In column 10, Claim 23, line 37, please delete “beating” and insert --bearing--.

Signed and Sealed this

Seventeenth Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 6,953,086 B2 
APPLICATION NO. : 10/432825
DATED : October 11, 2005
INVENTOR(S) : Neil Andrew Abercrombie Simpson It is certified that error appears in the above-identified patent and that said Letters Patent is hereby corrected as shown below:

In column 10, Claim 19, line 3, please delete “a” after “two”.

In column 10, Claim 19, line 4, please delete “;” after “body” and insert --,--.

In column 10, Claim 23, line 37, please delete “beating” and insert --bearing--.

This certificate supersedes Certificate of Correction issued October 17, 2006.

Signed and Sealed this

Twenty-first Day of November, 2006

JON W. DUDAS
*Director of the United States Patent and Trademark Office*